United States Patent [19]

Cassidy

[11] 4,249,550

[45] Feb. 10, 1981

[54] WAVE ROD

[76] Inventor: Harry E. Cassidy, 495 Kenny Rd., St. Paul, Minn. 55101

[21] Appl. No.: 78,084

[22] Filed: Sep. 24, 1979

[51] Int. Cl.[3] ..... A45D 2/26

[52] U.S. Cl. ..... 132/41 R

[58] Field of Search ..... 132/40, 41, 42, 39

[56] References Cited

U.S. PATENT DOCUMENTS

| | | | |
|---|---|---|---|
| 2,499,204 | 2/1950 | Weaver | 132/41 R |
| 2,611,398 | 9/1952 | King et al. | 132/41 R |
| 2,904,051 | 9/1959 | Corrado et al. | 132/40 |

*Primary Examiner*—G. E. McNeill

*Attorney, Agent, or Firm*—Richard E. Brink

[57] ABSTRACT

A wave rod for imparting curl to human hair comprises a tubular core having an integrally formed helical fin on its peripheral surface. Hair to be set is wound along the flat-bottomed helical channel formed between successive turns of the fin. A radially extending slot in the fin at the distal end of the rod permits accommodating strands of hair somewhat longer than the channel. A semi-cylindrical key integrally fixed in the distal end of the core and extending slightly therebeyond can be used to complementarily join two rods end-to-end, thereby effectively doubling the amount of channel available.

6 Claims, 4 Drawing Figures

WAVE ROD

This invention relates to wave rods for use in the setting or permanent waving of hair.

For many years it has been known that a desired curled configuration could be imparted to hair by moistening it and wrapping it around a stick, rod, etc., various setting or waving lotions being applied to enhance the duration of the curl. The so-called "wave rods", about which strands of hair are wrapped, have been made in a wide variety of shapes, e.g., straight, flat, grooved, twisted, split, etc.; see, e.g., U.S. Pats. No. 1,743,695, 1,895,653, 2,010,112, 2,335,086, 2,374,860 and 2,627,274.

Modern hair styles frequently incorporate numerous very tight curls, which are difficult to achieve using conventional wave rods. A recent development, the so-called Coppola rod, represents a variation of the rod shown in aforementioned U.S. Pat. No. 2,374,860, in which a strand of hair is twisted around and along a shallow concave groove defined by a gently undulating helix formed on the outside of a hollow rod; the strand is clipped at each end of the rod to hold it in position while being set. While purportedly designed for the formation of tight curls, this rod neither accommodates thick strands of hair nor is so effective in forming curls as professional hair dressers require.

The present invention provides a novel wave rod which is especially adapted for the formation of tight curls. Simple, convenient and easy to use, the rod comprises a tubular core having an integrally formed radially extending helical fin on its periphery, thereby providing a flat-bottomed channel helically winding about the core. The flat bottom and straight sides of the channel enable a thick strand of hair to be wound tightly, resulting in the formation of tighter curls and a fuller coiffure than was possible with prior art wave rods. In a preferred embodiment of the invention, the last turn of the helix adjacent the distal end of the rod is provided with a radial notch to permit the accommodation of a strand of hair whose length exceeds that of the helical channel; such a strand is passed through the notch, doubled back, and wrapped around a portion of the hair lying in the channel. For still longer strands, a semi-cylindrical key, integrally formed within the core at its distal end and extending therebeyond, permits the complementary end-to-end joining of two rods.

Attention is now directed to the accompanying drawing, in which

Figure 1:
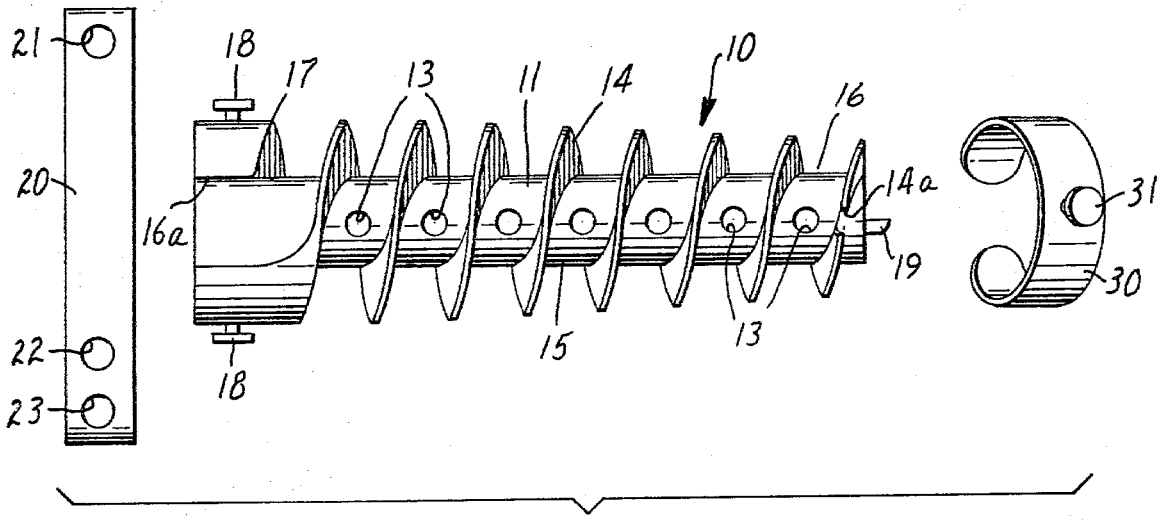
FIG. 1 is an exploded side view showing a rod in accordance with the invention, together with the hair-holding clips used at its two ends.
Figure 2:
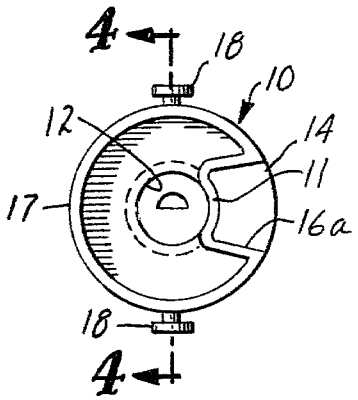
FIG. 2 is a view from the left end of the rod of FIG. 1.
Figure 3:
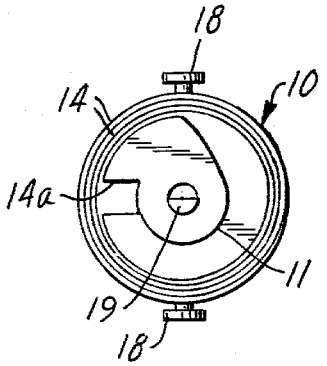
FIG. 3 is a view from the right end thereof.
Figure 4:
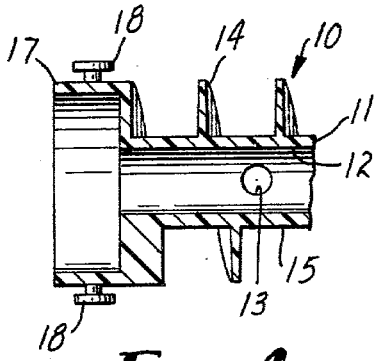
FIG. 4 is a partial longitudinal cross-sectional view of the rod taken along section line 4—4 of FIG. 2, looking in the direction of the arrows.

In the drawing, FIG. 1 depicts wave rod 10, elastomeric band 20, and clip 30, all of which are used in combination to shape a strand of hair and hold it in place. Wave rod 10 comprises tubular core 11, having hollow interior 12 and peripheral surface 15, between which holes 13 extend radially to permit the ready passage of setting lotion or other hair styling liquid. Integrally formed with core 11 is helical fin 14, a thin blade-like member which extends radially and defines, between adjacent turns, a generally flat-bottomed channel 16 winding about peripheral surface 15 to accommodate a strand of hair. Located at the left end of wave rod 10, as seen in FIG. 1, is head, or proximal, portion 17, having a generally axially extending peripheral channel **16*a* which blends into helical channel 16. In use, proximal portion 17 is positioned adjacent the scalp and a strand of hair led through channel 16*a* into helical channel 16. Taking into account the fact that the thickness of a strand decreases as the distance from the scalp increases, the radial height of helical fin 14 decreases gradually as it winds about surface 15. The last turn of fin 14, adjacent the right, or distal, end of rod 10, is provided with radially extending notch 14*a*; a strand of hair which is slightly longer than helical channel 16 can be passed through notch 14*a*, doubled back, and wound upon itself in the distal portion of helical channel 16**.

Protruding radially from proximal portion 17 are knobs 18. After a strand of hair has been positioned in channel **16*a*, elastomeric band 20 is used to hold it in position. Band 20 is provided with holes 21, 22 and 23; hole 21 is slipped over one knob 18 and band 20 stretched across the strand as it lies in channel 16*a*. Either hole 22 or 23, as appropriate, is then slipped over the other knob 18**.

After a strand of hair has been wound about rod 10 along helical channel 16, spring clip 30, having gripping knob 31 to assist in mounting and demounting, is slipped over the distal portion of rod 10 to hold the strand in position.

In the preceding description, flat-bottomed channel 16 has been emphasized. It has been found that the amount of peripheral surface 15 which is exposed (and which constitutes the bottom of channel 16) should be maximized for tightest curls and most uniform results; thus, the thickness of helical fin 14 should likewise be minimized. As a rule of thumb, it has been found that at least 75%, and preferably about 90%, of peripheral surface 15 should be exposed.

If, as frequently occurs in setting long hair, a a single wave rod 10 is not long enough to accommodate a full strand of hair (even when doubled back as previously described), the present invention provides a means for temporarily joining two such rods. Integrally fixed within hollow interior 12, at the distal end of rod 10 and extending axially slightly therebeyond, is semi-cylindrical key 19. A pair of rods 10 can be joined end-to-end by inserting the key 19 of each into the corresponding semi-circular opening of the other, the keys abutting each other laterally.

Rod 10 and clip 31 are conveniently formed from a light, tough polymer such as linear polyethylene, isotactic polypropylene, high impact polystyrene, etc. Products formed of such polymers can be dyed or pigmented to achieve any desired color; it has been found convenient to make rods having clockwise helical fins 14 a different color from those having counterclockwise helical fins 14.

In wrapping a strand of hair about rod 10, the degree of curl obtained can be varied dramatically by the degree to which the strand is twisted before wrapping. A full counterclockwise twist, for example, imparts a tight curl to a strand of hair which is wound about a rod having a helical fin, a half twist imparting a significantly looser curl.

What is claimed is as follows:

1. A wave rod for use in imparting curl to hair, said rod having a proximal end and a distal end and comprising a tubular core having an integrally formed helical fin on its peripheral surface, a substantial portion of said peripheral surface being exposed between successive turns of said fin, thereby providing a flat-bottomed helical channel for accommodating a strand of hair.

2. The wave rod of claim 1 wherein at least about 75% of said peripheral surface is exposed.

3. The wave rod of claim 2 wherein a radial notch extends through the portion of the fin adjacent the distal end, thereby permitting a strand of hair to be wound through the helical channel, passed through said notch, and rewound about the distal portion of said channel.

4. The wave rod of claim 2 or 3 wherein a semi-cylindrical key is integrally fixed within the distal end of the hollow interior of the core, extending slightly axially therebeyond, whereby the length of available wave rod can be effectively doubled by joining the distal end of two such rods, the keys of the two rods laterally abutting and respectively extending into the hollow interiors of each other.

5. The wave rod of claim 4 wherein the radial height of the helical fin is less at the distal end of the wave rod than at the proximal end.

6. The wave rod of claim 5 wherein holes extend radially from the periphery of the rod to its hollow interior, thereby facilitating the passage of setting lotion to strands of hair wound in the helical channel.

* * * * *